United States Patent [19]

Sittler

[11] 4,259,803

[45] Apr. 7, 1981

[54] PORTABLE SIGN

[76] Inventor: Edwin C. Sittler, 355 N. Pine, P.O. Box 1962, Grand Island, Nebr. 68801

[21] Appl. No.: 109,381

[22] Filed: Jan. 3, 1980

Related U.S. Application Data

[63] Continuation-in-part of Ser. No. 883,107, Mar. 3, 1978, abandoned.

[51] Int. Cl.[3] ..... G09F 7/18

[52] U.S. Cl. ..... 40/607; 40/610

[58] Field of Search ..... 40/607, 606, 610, 611, 40/605, 612; 248/530, 533

[56] References Cited

U.S. PATENT DOCUMENTS

| | | | |
|---|---|---|---|
| 1,649,249 | 11/1927 | Newman | 40/607 |
| 2,881,543 | 4/1959 | De Rowen | 40/607 |
| 2,939,236 | 6/1960 | Stein | 40/607 X |
| 3,143,817 | 8/1964 | Paulson | 40/606 |
| 3,200,786 | 8/1965 | Swezy et al. | 40/610 X |
| 3,350,804 | 11/1967 | Guyer, Jr. et al. | 40/610 X |
| 3,370,369 | 2/1968 | Look | 40/607 |
| 4,009,532 | 3/1977 | Thomas | 40/606 |
| 4,173,086 | 11/1979 | Hempfling | 40/607 |

*Primary Examiner*—John F. Pitrelli

*Attorney, Agent, or Firm*—Henderson & Sturm

[57] ABSTRACT

A portable sign having a lightweight, detachable framework, sign support and ground engaging means is disclosed. The sign is further provided with reinforcing means which seal, add weight and stiffen the reversible foldable sign face and which cooperates with portions of the framework to maintain the sign face in its intended position.

6 Claims, 5 Drawing Figures

PORTABLE SIGN

This application is a continuation in part of Ser. No. 883,107, Mar. 3, 1978 now abandoned.

BACKGROUND OF THE INVENTION

Field of the Invention

This invention relates generally to a method and apparatus useful for displaying messages, and specifically to such method and apparatus which will provide for a highly portable, lightweight, inexpensive yard sign.

Prior Art

Lightweight signs, and in particular, yard signs, are currently in wide use and have been in use since antiquity. Some such signs are more or less of a permanent nature, while others such as those used in real estate sales, political campaigns, construction, manufacturer's product identification, and garage sales, are employed for a short time only.

Of the temporary class of yard sign, the most common types employ one or more support legs or posts, a sign holding frame attached to the legs, and one or more sign faces. They are generally constructed out of wood, however, some less temporary signs used in real estate sales employ metal frames and metal or plastic sign faces.

All of the prior art signs suffer, however, from one common fault in that the cost of the sign increases as the sign is made more durable. Also, as the conventional yard signs do not allow the desired message to be inexpensively changed, their usefulness is limited.

Some examples of prior art signs may be found by reference to the following U.S. Pat. No's; 2,064,240; 2,072,573 and 2,022,160.

In addition, conventional signs and in particular, those signs utilizing two or more posts, require at least two people to place them in the ground. And signs which use only one post are subject to the wind turning and general instability in use. It may also be noted that it is extermely difficult for one person to insert a conventional yard sign in frozen ground.

Most yard signs are cumbersome unwieldy and occupy a great deal of space in storage and during transportation. They also suffer from a lack of support on their edges which make the sign faces difficult to install and remove, and which permit a great deal of flexure in the sign face which leads to the fraying and tearing thereof.

Consequently, there exists a need for a yard sign that is durable, inexpensive, capable of many applications, easily inserted in the ground by one person, and stable in high winds.

SUMMARY OF THE INVENTION

One of the objects of this invention is to provide a method and apparatus useful for displaying messages.

Another object of is to provide a lightweight, portable, detachable yard sign framework which is readily transported and easily assembled.

Another object is to provide a yard sign assembly which permits quick and easy changes to the message displayed.

Yet another object is to provide an easily erected yard sign which can be manufactured with an minimum of labor, is inexpensive to produce, and yet is durable and may be reused many times.

Yet another object is to provide a low cost yet durable sign which is stable in high winds by virtue of weighted reinforcing means which allow limited lateral displacement of the sign face on the framework.

A further object of the invention is to provide a low cost sign having easily varied multiple messages upon the sign face.

A further object of the invention is to provide a detachable sign framework having a driving pad attached thereto to assist in the erection of the sign, and which will occupy very little space during transport.

A still further object is to provide a sign having a foldable sign face which is easily reversed by virtue of releasable weighted sealing means.

These objects and other features and advantages of this invention will become readily apparent upon reference to the following description when taken in conjunction with their accompanying drawings.

DESCRIPTION OF THE PREFERRED EMBODIMENT

Figure 1:
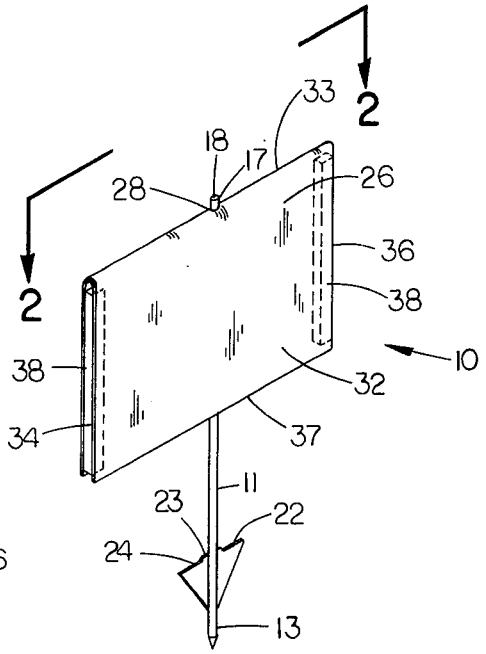
FIG. 1 is a perspective view of the portable sign of the instant invention showing the location of the releasable weighted stiffening and securing means.

Referring now to FIG. 1 the sign of the instant invention is indicated generally as 10 and comprises a framework 11 which supports a folded sign face 26 which is releasably sealed, weighted and stiffened along its edges 34 and 36 via members 38.

Figure 2:
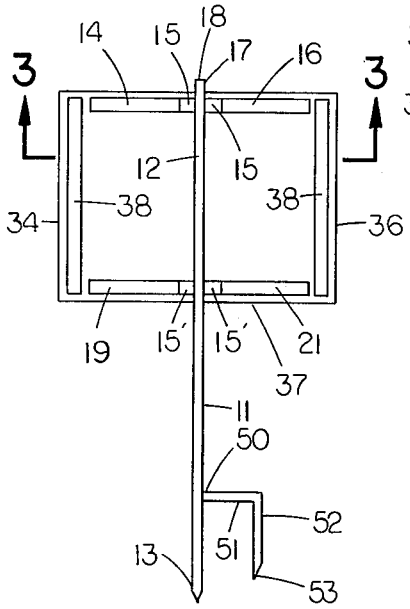
FIG. 2 is a cross sectional view taken along lines 2—2 of FIG. 1 showing the support and stiffening structure between the sign faces.

As can be seen in FIG. 2 the framework 11 includes an elongated vertical member 12 having a pointed end 13 and a plurality of upper and lower hollow tubular members 15, 15' arranged in diametrically opposed pairs along its length. The tubular members 15 releasably support a pair of elongated upper horizontal rod members 14 and 16.

A tip structure 17 projects beyond and above the intersection of the vertical member 12 and the upper hollow tube members 15 and their associated horizontal rod members 14 and 16 therefore providing a driving pad 18. An additional cap (not shown) may be attached to the driving pad 18. Such a pad 18 should be made of a material which is capable of accepting a striking force and transferring that force longitudinally through the vertical member 12.

Figure 4:
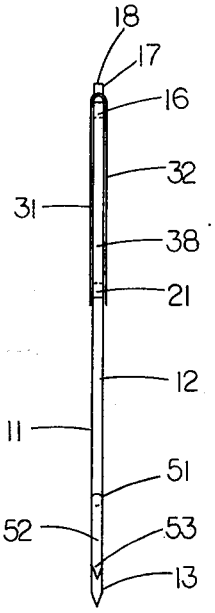
FIG. 4 is a side elevational view thereof; showing the narrow profile of a sign made in accordance with this invention.

As can be seen in FIGS. 1, 2, and 4, the driving pad 18 is a continuation of the vertical member 12 itself beyond the intersection of the horizontal members 14 and 16 via tubes 15. As seen in FIG. 2, a pair of elongated, lower horizontal members 19 and 21 are removably attached at a point substantially midpoint on the vertical member 12 in the same manner as the upper horizontal members 14 and 16 via lower tube pair 15'. The lower horizontal members 19 and 21 are supported substantially coplanar with and paralled to the upper horizontal members 14 and 16 in the tubes 15'. Both the upper horizontal members 14 and 16 and the lower horizontal members 19 and 21 are inserted substantially perpendicular to the vertical member 12 in their respective tube pairs 15 15'.

In FIG. 1 a stabilizing plate 22 is attached below the lower horizontal members 19 and 21 and above the lower end 13 of the vertical member 12. The placement of the plate 22 is such that when the lower end 13 of the vertical member 12 is inserted in the ground, the plate 22 is also disposed beneath ground level. The plate 22 is attached to the vertical member 12 so that it is coplanar with with the upper horizontal tube pair 15 and the lower horizontal tube pair 15'. The coplanar disposition of the horizontal tube pairs 15, 15' and the ground engaging plate 22 facilitates the stacking of a plurality of such sign 10 for easier shipment and storage. This is further enhanced by the removal of the rod members 14, 16, 19 and 21.

As can be seen in FIG. 1, the plate 22 can be constructed in a single piece having a vertical groove 23 therein welded or otherwise attached to the vertical support member 12 such that the plane of the plate 22 passes substantially through the center of the vertical support member 12. Any geometric shape plate would have a stabilizing effect upon the sign 10 when the sign 10 is inserted in the ground, however, a triangular plate 22 as depicted in FIG. 1 is much easier to insert into the ground and could be used to help position the sign 10 for insertion. Initial ground insertion may be accomplished by stepping on the upper edge 24 of the plate with one foot to position and start the lower end 13 of the vertical member 12 into the ground.

An alternate construction for the plate 22 may be seen in FIG. 2 wherein the elongated rod 12 is provided with an L shaped pointed extension or positioning device 50 which is co-planer with the tube pairs 15, 15' and comprises a horizontal portion 51 and a downwardly depending vertical portion 52 which terminates in a point 53. The horizontal portion 51 provides a bearing surface for force to be transmitted downwardly through the points 13 and 53.

Figure 5:
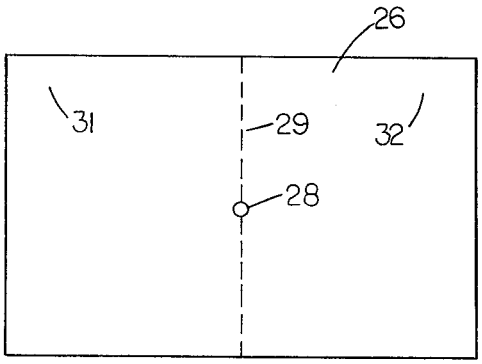
FIG. 5 is a top plan view of the unfolded sign face of the instant invention wherein the dash line indicates the general line of the fold.

As shown in FIGS. 1 and 2, a unitary sign face 26 rests on the upper tubular pair 15 and is supported by the upper horizontal rod members 14 and 16. As shown in FIG. 5, the sign face is substantially rectangular, however, any desired shape may be utilized with a corresponding alteration of length of removeable horizontal rod members 14, 16, 19 and 21. It may be noted that the sign face 26 can be printed on both sides as the sign face 26 is easily reversed.

As depicted in FIG. 5, a hole 28 is provided approximately at the midpoint of the sign face 26 and a fold 29 is made to bisect the hole 28 and sign face 26 to produce two external surfaces 31 and 32. When the sign face 26 is folded in such a manner, the plane of each external surface 31 and 32 is substantially parallel to the other. The hole 28 is positioned at the approximate midpoint of the unfolded sign face 26. When the sign face 26 folded the hole 28 is positioned at the uppermost edge 33 to coact with the previously described driving pad 18 to aid in the placement of the sign face on the upper horizontal rod members 14 and 16. The upper horizontal members 14 and 16 coact with the folded sign face 26 to provide support for the folded sign face 26 along the fold line 29.

The folded sign face 26 is placed on the upper horizontal members 14 and 16 so that the driving pad 18 projects through the hole 28 located on the upper edge 33 of the sign face 26. The edges 34,26 of the sign face are sealed in the manner depicted in FIGS. 1 and 2 so that the sign face 26 is held securely to the framework 11.

As is well known by those skilled in this art, any convenient method of joining the edges 34, 36 and 37 of the parallel sign faces 31 and 32 may be employed such as gluing, lacing, taping, or clipping along the edges 34, 36 and 37 of the two sign faces 31 and 32; however this leads to the problems enumerated supra, and of course, in order to utilize the reversible feature of the foldable sign face 26, it would be necessary that the method of joining the edges be such that the attachment may be easily removed when it becomes desirable to reverse the sign face.

To accomplish this objective, elongated rigid stiffening members 38 are releasably secured to the interior of the sign face 26 proximate the edges 34 and 36. The members 38 are greater in length than the distance between the upper and lower tube pairs 15, 15' and form an envelope from the sign face 26 when they are affixed, leaving only the edge 37 open. The members 38 are rigid, heavier than the surrounding sign face material and may be fabricated from wood, plastic, or metal. The members 38 must also be chosen from material which provides a surface which will receive a releasable securing means such as a double stick tape, or the like, so that the members 38 will seal the edges 34 and 36.

When the members 38 are positioned on the interior surface of the sign face as illustrated in FIG. 2 they enhance the entire assembly 10 in the following manner; they add weight to the sign face 26 increasing the frictional contact of the interior of the uppermost face 33 upon the supporting tube pair 15 and horizontally disposed rods 14 and 16; they seal and stiffen the edges 34 and 36 reducing flutter and subsequent tearing of the sign face material; they insure that the opposing surfaces of the sign face will remain flat and parallel in their suspended, supported and spaced position; they facilitate the positioning of the sign face on the supporting framework 11 by allowing the sign face to be preassembled in envelope shape, grasped by the rigid edges 34 and 36, flexed together slightly, the opening 37 will become bowed outwardly and the hole 28 can be readily inserted over the cap 18; and they further provide abuttment surfaces for the ends of the horizontally disposed removeable rods 14, 16, 19 and 21 to allow slight lateral displacement of the sign face 26 on the supporting framework 11.

It must be noted that when the sign face 26 is made of heavy material, the fold 29 employed to bring the external sign faces 31 and 32 parallel to one another, may require multiple creases substantially along the fold line 29 as depicted in FIG. 5.

In order to produce a more uniform flat appearing sign face 26, and in particular when heavier materials are utilized, wider stiffening members 38 are inserted along the vertical edge 34 and 36 of the folded sign face 26 and between the two sign face surfaces 31 and 32, as shown in FIG. 4.

As shown in FIGS. 2 and 4, these vertical elongated stiffening members 38 are utilized to help space and seal the foldable sign face. In addition, stiffening members 38 may be utilized below the lower horizontal members 19 and 21 in another embodiment (not shown) in which the lower edge 37 of the foldable sign face 26 extends substantially below the lower horizontal members 19 and 21.

The method of construction and assembly of the portable sign 10 may now be disclosed. Two pairs 15, 15' of hollow tubes are butt welded at diametrically opposed positions at the appropriate locations on a elongated vertical rod 12 having the same external diameter as the external diameter of each tube in the opposed pairs 15, 15'. Four horizontal rods 14, 16, 19 and 21 are then inserted into the tubes to produce the support framework 11. The driving pad 18 assists in guiding and securing the foldable sign face 26. A printed sign face 26 having a hole 28 disposed at approximately its midpoints is folded so that the fold line 29 bisects the hole 28 and the printed sign 26. The folded sign face 26 is then placed on the framework 11 with the tip structure 17 and driving pad 18 projecting through the hole 28. The sign face 26 is then attached to the frame and sealed by applying the stiffening members 38 between the sign face planes 31 and 32. The sign 10 is transported to location and placed upon the ground so that the sign 10 may be readily observed by passersby. The sign 10 is then grasped by the tip structure 17 and initially inserted into the ground by placing a foot upon the stabilizing plate 22 in one embodiment or the horizontal members 51 in another embodiment. A hammer is applied to the driving pad 18 until the ground engaging stabilizing plate 22 or positioning device 50 is inserted beneath the ground.

When it is desired to change the message on the sign 10, the sign face 26 is grasped along the opening 37 and the sign surfaces 31 and 32 are manually separated from the sealing weighted stiffening members 38, which are then repositioned on the former face of the sign which now becomes the interior of the sign.

Figure 3:
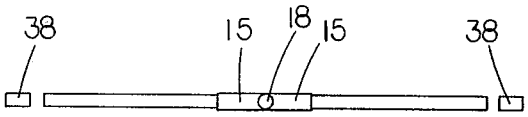
FIG. 3 is a top view thereof; showing the detachable rods and the spacing of the stiffening members with respect thereto.

As can be seen in FIGS. 2 and 3, the stiffening members 38 and sign face 26 are dimensioned such that when the members 38 are in their installed position they will allow limited lateral movement of the sign face, but will not allow the horizontal removeable rods 14, 16, 19 and 21 to work loose from their opposed tube pairs 15, 15'. In essence the stiffening members 38 act as a keeper mechanism for the sign framework assembly 11.

Other sequences of constructing, using and erecting portable signs are, of course, well within the skill of those in this art and within the skill of a person who would be utilizing such equipment.

Obviously, many modifications and variations of the present invention are possible in light of the above teachings. It is therefore to be understood, that within the scope of the appended claims, the invention may be practised otherwise than is specifically described.

I claim:

1. A portable sign comprising:

(a) vertical frame means having a first end and a second end wherein said first end includes a driving pad attached thereto and wherein said second end includes at least one ground engaging means attached thereto;

(b) horizontal sign support arms attached to vertical frame means between said first end and said second end, said arms comprise a plurality of horizontally disposed rod elements which are attached to the vertical frame means in vertically spaced opposed pairs;

(c) foldable sign face means having a hole disposed substantially within the midpoint of said sign face and wherein said sign face is folded substantially along a fold line bisecting said hole whereby said sign face comprises two parallel sign surfaces and wherein said sign faces are supported by said outwardly extending horizontal sign support arms along said fold line and wherein said driving pad projects through said hole in said foldable sign faces;

(d) elongated, rigid sign edge stiffening members disposed along and coacting with the edges of the sign face wherein said parallel sign faces surfaces are releasably joined to said stiffening members, said stiffening members are fabricated from material which is heavier than the surrounding sign face material; the vertical spacing of the opposed pairs of rod elements is less than the length of the elongated stiffening members; and said parallel sign surfaces when releasably joined to said stiffening members form an inverted envelope from said foldable sign face.

2. A portable sign as in claim 1 wherein said plurality of horizontally disposed rod elements are releasably held in tubes which are rigidly secured to said vertical frame means.

3. A portable sign as in claim 1 wherein the stiffening members add weight, and rigidity to the sign edges.

4. A portable sign as in claim 3 wherein the stiffening members are adhesively joined to said parallel sign surfaces.

5. A portable sign as in claim 4 wherein the stiffening members limit the lateral displacement of the sign face on the vertical frame means.

6. A portable sign as in claim 5 wherein the stiffening members form spaced abuttment surfaces for said horizontal sign support arms.

* * * * *